US006672829B1

(12) United States Patent
Cherry et al.

(10) Patent No.: US 6,672,829 B1
(45) Date of Patent: Jan. 6, 2004

(54) TURBINE BLADE HAVING ANGLED SQUEALER TIP

(75) Inventors: David Glenn Cherry, Loveland, OH (US); Ching-Pang Lee, Cincinnati, OH (US); Chander Prakash, Cincinnati, OH (US); Aspi Rustom Wadia, Loveland, OH (US); Brian David Keith, Cincinnati, OH (US); Steven Robert Brassfield, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 7 days.

(21) Appl. No.: 10/196,623

(22) Filed: Jul. 16, 2002

(51) Int. Cl.[7] ..... F01D 5/18
(52) U.S. Cl. ..... 415/115; 416/97 R
(58) Field of Search ..... 415/115, 116, 415/173.4; 416/97 R, 224

(56) References Cited

U.S. PATENT DOCUMENTS

| | | | | |
|---|---|---|---|---|
| 5,261,789 | A | 11/1993 | Butts et al. | 416/96 R |
| 5,458,461 | A | 10/1995 | Lee et al. | 416/97 R |
| 5,564,902 | A | 10/1996 | Tomita | 416/97 R |
| 6,027,306 | A | 2/2000 | Bunker | 415/173.5 |
| 6,039,531 | A | 3/2000 | Suenaga et al. | 415/115 |
| 6,059,530 | A | 5/2000 | Lee | 416/97 R |
| 6,086,328 | A | 7/2000 | Lee | 416/97 R |
| 6,164,914 | A | 12/2000 | Correia et al. | 416/97 R |
| 6,176,678 | B1 | 1/2001 | Brainch et al. | 416/97 R |
| 6,179,556 | B1 | 1/2001 | Bunker | 415/115 |
| 6,183,199 | B1 | 2/2001 | Beeck et al. | 416/97 R |
| 6,190,129 | B1 | 2/2001 | Mayer et al. | 416/97 R |
| 6,224,336 | B1 | 5/2001 | Kercher | 416/97 R |
| 6,382,913 | B1 | 5/2002 | Lee et al. | 416/96 R |

*Primary Examiner*—Edward K. Look
*Assistant Examiner*—Kimya N McCoy
(74) *Attorney, Agent, or Firm*—William Scott Andes; James P. Davidson

(57) ABSTRACT

A turbine blade for a gas turbine engine, including an airfoil and integral dovetail for mounting the airfoil along a radial axis to a rotor disk inboard of a turbine shroud. The airfoil further includes: first and second sidewalls joined together at a leading edge and a trailing edge, where the first and second sidewalls extend from a root disposed adjacent the dovetail to a tip plate for channeling combustion gases thereover; and, at least one tip rib extending outwardly from the tip plate between the leading and trailing edges. The tip rib is oriented so that an axis extending longitudinally therethrough is at an angle with respect to the radial axis for at least a designated portion of an axial length of the turbine blade. Such angle may be substantially the same across the designated portion or may vary thereacross. Accordingly, a recirculation zone of the combustion gases is formed adjacent a distal end of the tip rib which reduces a leakage flow of the combustion gases between the airfoil and the shroud for at least the designated portion of an axial length of the turbine blade.

25 Claims, 6 Drawing Sheets

TURBINE BLADE HAVING ANGLED SQUEALER TIP

BACKGROUND OF THE INVENTION

The present invention relates generally to turbine blades for a gas turbine engine and, in particular, to the cooling of the tip and the tip leakage flow of such turbine blades.

It is well known that air is pressurized in a compressor of a gas turbine engine and mixed with fuel in a combustor to generate hot combustion gases, whereupon such gases flow downstream through one or more turbines so that energy can be extracted therefrom. In accordance with such turbine, a row of circumferentially spaced apart rotor blades extend radially outwardly from a supporting rotor disk. Each blade typically includes a dovetail which permits assembly and disassembly of the blade in a corresponding dovetail slot in the rotor disk, as well as an airfoil which extends radially outwardly from the dovetail.

The airfoil has a generally concave pressure side and generally convex suction side extending axially between corresponding leading and trailing edges and radially between a root and a tip. It will be understood that the blade tip is spaced closely to a radially outer turbine shroud for minimizing leakage therebetween of the combustion gases flowing downstream between the turbine blades. Maximum efficiency of the engine is obtained by minimizing the tip clearance or gap, but is limited by the differential thermal and mechanical expansion and contraction between the rotor blades and the turbine shroud for reducing the likelihood of undesirable tip rubs.

Since the turbine blades are bathed in hot combustion gases, effective cooling is required for ensuring a useful life. The blade airfoils are hollow and disposed in flow communication with the compressor so that a portion of pressurized air bled therefrom is received for use in cooling the airfoils. Airfoil cooling is quite sophisticated and may be effected using various forms of internal cooling channels and features, as well as cooling holes through the walls of the airfoil for discharging the cooling air.

The airfoil tip is particularly difficult to cool since it is located directly adjacent to the turbine shroud and the hot combustion gases which flow through the tip gap therebetween. Accordingly, a portion of the air channeled inside the airfoil is typically discharged through the tip for cooling thereof. The tip typically includes a continuous radially outwardly projecting edge rib disposed coextensively along the pressure and suction sides between the leading and trailing edges, where the tip rib follows the aerodynamic contour around the airfoil and is a significant contributor to the aerodynamic efficiency thereof.

Generally, the tip rib has portions spaced apart on the opposite pressure and suction sides to define an open top tip cavity. A tip plate or floor extends between the pressure and suction side ribs and encloses the top of the airfoil for containing the cooling air therein. Tip holes are also provided which extend through the floor for cooling the tip and filling the tip cavity.

It will be appreciated that several exemplary patents related to the cooling of turbine blade tips are disclosed in the art, including: U.S. Pat. No. 5,261,789 to Butts et al.; U.S. Pat. No. 6,179,556 to Bunker; U.S. Pat. No. 6,190,129 to Mayer et al.; and, U.S. Pat. No. 6,059,530 to Lee. These patents disclose various blade tip configurations which include an offset on the pressure and/or suction sides in order to increase flow resistance through the tip gap. Nevertheless, improvement in the pressure distribution near the tip region is still sought to further reduce the overall tip leakage flow and thereby increase turbine efficiency.

Thus, in light of the foregoing, it would be desirable for a turbine blade tip to be developed which alters the pressure distribution near the tip region to reduce the overall tip leakage flow and thereby increase the efficiency of the turbine. It is also desirable for such turbine blade tip to develop one or more recirculation zones adjacent the ribs at such tip in order to improve the flow characteristics and pressure distribution at the tip region.

BRIEF SUMMARY OF THE INVENTION

In a first exemplary embodiment of the invention, a turbine blade for a gas turbine engine is disclosed as including an airfoil and integral dovetail for mounting the airfoil along a radial axis to a rotor disk inboard of a turbine shroud. The airfoil further includes: first and second sidewalls joined together at a leading edge and a trailing edge, where the first and second sidewalls extend from a root disposed adjacent the dovetail to a tip plate for channeling combustion gases thereover; and, at least one tip rib extending outwardly from the tip plate between the leading and trailing edges. The tip rib is oriented so that an axis extending longitudinally therethrough is at an angle with respect to the radial axis for at least a designated portion of an axial length of the turbine blade. The angle between the longitudinal axis and the radial axis may be substantially the same across the designated portion or may vary thereacross.

In a second exemplary embodiment of the invention, a turbine blade for a gas turbine engine is disclosed as including an airfoil and integral dovetail for mounting the airfoil along a radial axis to a rotor disk inboard of a turbine shroud. The airfoil further includes: first and second sidewalls joined together at a leading edge and a trailing edge, where the first and second sidewalls extend from a root disposed adjacent the dovetail to a tip plate for channeling combustion gases thereover; and, at least one tip rib extending outwardly from the tip plate between the leading and trailing edges. The tip rib is oriented with respect to the radial axis so that a first recirculation zone of the combustion gases is formed adjacent a distal end of the tip rib which reduces a leakage flow of the combustion gases between the airfoil and the shroud for at least a designated portion of an axial length of the turbine blade.

DETAILED DESCRIPTION OF THE INVENTION

Figure 1:
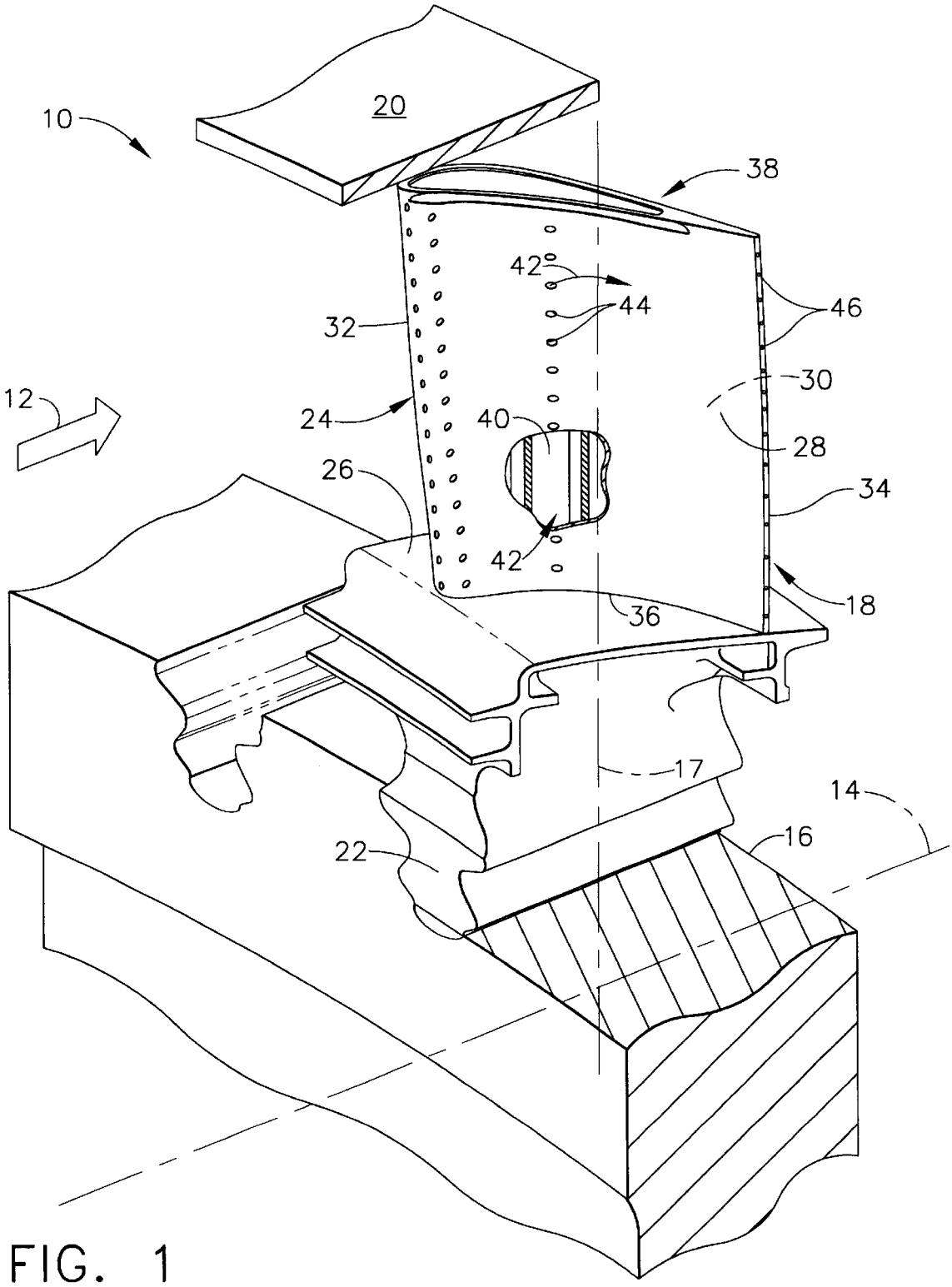
FIG. 1 is a partly sectional, isometric view of an exemplary gas turbine engine rotor blade mounted in a rotor disk within a surrounding shroud, with the blade having a tip in accordance with an exemplary embodiment of the present invention.
Figure 2:
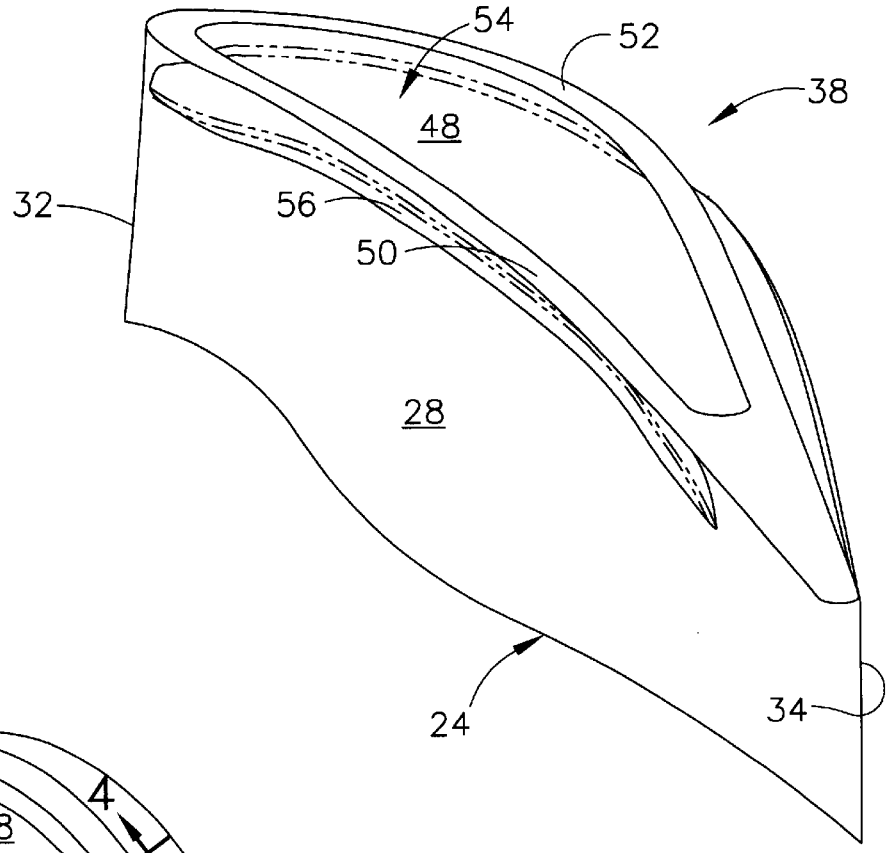
FIG. 2 is an isometric view of the blade tip as illustrated in FIG. 1 having a pair of aerodynamic tip ribs in accordance with an exemplary embodiment.
Figure 3:
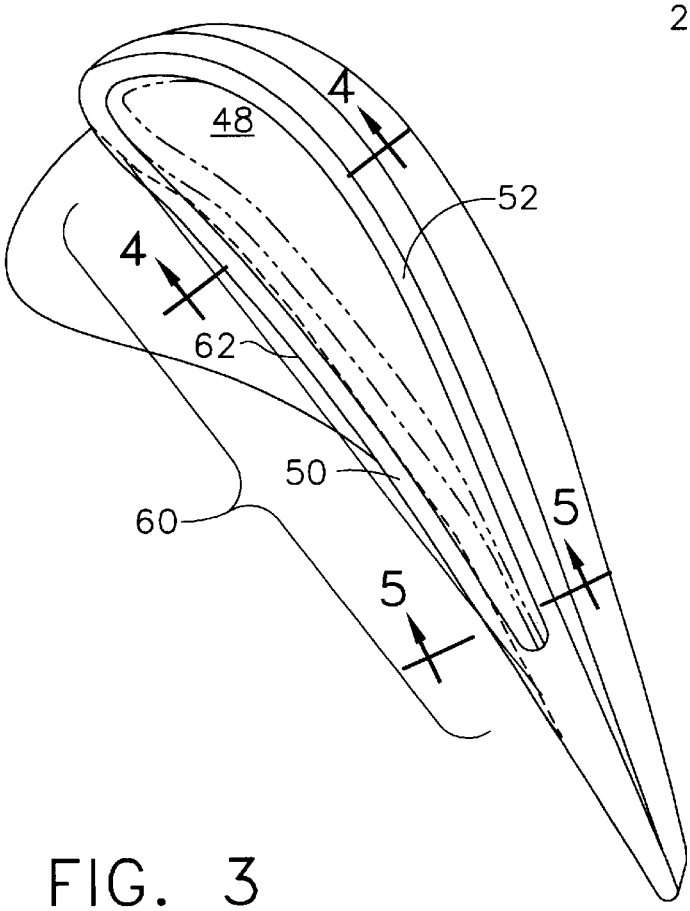
FIG. 3 is a top view of the blade tip illustrated in FIGS. 1 and 2.

Referring now to the drawings in detail, wherein identical numerals indicate the same elements throughout the figures, FIG. 1 depicts a portion of a high pressure turbine 10 of a gas turbine engine which is mounted directly downstream from a combustor (not shown) for receiving hot combustion gases 12 therefrom. Turbine 10, which is axisymmetrical about an axial centerline axis 14, includes a rotor disk 16 and a plurality of circumferentially spaced apart turbine rotor blades 18 (one of which being shown) extending radially outwardly from rotor disk 16 along a radial axis 17. An annular turbine shroud 20 is suitably joined to a stationary stator casing (not shown) and surrounds blades 18 for providing a relatively small clearance or gap therebetween for limiting leakage of combustion gases 12 therethrough during operation.

Each blade 18 preferably includes a dovetail 22 which may have any conventional form, such as an axial dovetail configured for being mounted in a corresponding dovetail slot in the perimeter of the rotor disk 16. A hollow airfoil 24 is integrally joined to dovetail 22 and extends radially or longitudinally outwardly therefrom. Blade 18 also includes an integral platform 26 disposed at the junction of airfoil 24 and dovetail 22 for defining a portion of the radially inner flowpath for combustion gases 12. It will be appreciated that blade 18 may be formed in any conventional manner, and is typically a one-piece casting.

It will be seen that airfoil 24 preferably includes a generally concave first or pressure sidewall 28 and a circumferentially or laterally opposite, generally convex, second or suction sidewall 30 extending axially or chordally between opposite leading and trailing edges 32 and 34, respectively. Sidewalls 28 and 30 also extend in the radial or longitudinal direction between a radially inner root 36 at platform 26 and a radially outer tip 38. Further, first and second sidewalls 28 and 30 are spaced apart in the lateral or circumferential direction over the entire longitudinal or radial span of airfoil 24 to define at least one internal flow chamber or channel 40 for channeling cooling air 42 through airfoil 24 for cooling thereof. Cooling air 42 is typically bled from the compressor (not shown) in any conventional manner.

The inside of airfoil 24 may have any configuration including, for example, serpentine flow channels with various turbulators therein for enhancing cooling air effectiveness, with cooling air 42 being discharged through various holes through airfoil 24 such as conventional film cooling holes 44 and trailing edge discharge holes 46.

As seen in FIGS. 2–5, blade tip 38 preferably includes a tip floor or plate 48 disposed integrally atop the radially outer ends of first and second sidewalls 28 and 30, where tip plate 48 bounds internal cooling channel 40. A first tip wall or rib 50 preferably extends radially outwardly from tip plate 48 between leading and trailing edges 32 and 34 adjacent first (pressure) sidewall 28. A second tip wall or rib 52 also preferably extends radially outwardly from tip plate 48 between leading and trailing edges 32 and 34, and is spaced laterally from first tip rib 50 adjacent second (suction) sidewall 30 to define an open-top tip channel 54 therebetween. Although tip channel 54 is shown as being enclosed by first and second tip ribs 50 and 52, it is consistent with the present invention for tip channel 54 to include a tip inlet and tip outlet as disclosed in U.S. Pat. No. 6,059,530 to Lee to assist in discharging combustion gases 12 through tip channel 54.

As shown in FIGS. 2–5, first tip rib 50 is preferably recessed from first sidewall 28 to form a tip shelf 56 substantially parallel to tip plate 48 as has been disclosed in the art to improve cooling of tip 38. Contrary to the tip rib configurations previously shown, where the tip ribs have been oriented substantially parallel to radial axis 17 throughout, the present invention preferably provides that a longitudinal axis 58 extending through first tip rib 50 (see FIG. 4) be formed at an angle θ to radial axis 17 for at least a designated portion 60 of an axial length of turbine blade 18.

Figure 4:
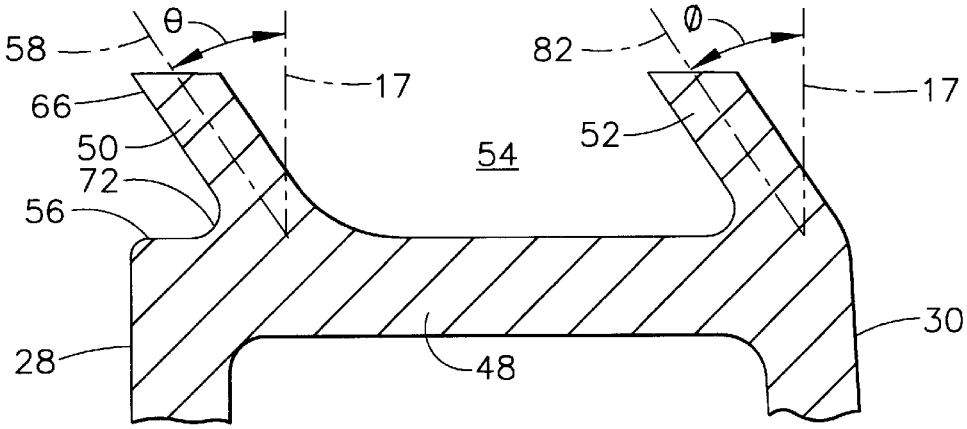
FIG. 4 is an elevational, sectional view through the blade tip illustrated in FIG. 3 within the turbine shroud, taken generally along line 4—4, and depicting a maximum angle between a longitudinal axis through the blade tip ribs and the radial axis.
Figure 5:
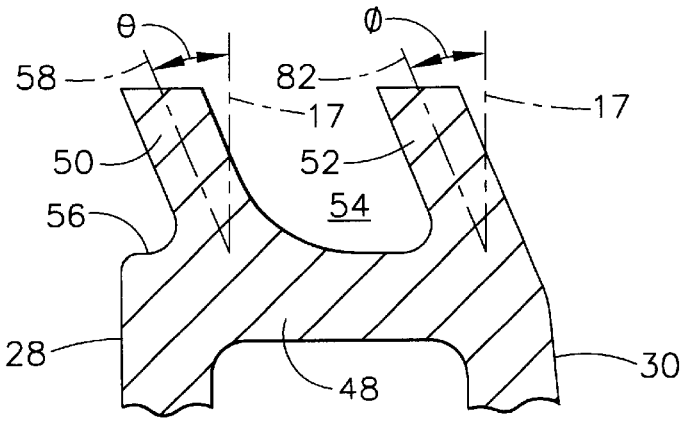
FIG. 5 is an elevational, sectional view through the blade tip illustrated in FIG. 3 within the turbine shroud, taken generally along line 5—5, and depicting a minimum angle between a longitudinal axis through the blade tip ribs and the radial axis.

Although angle θ may be substantially the same or fixed across designated portion 60, it is preferred that angle θ vary across designated portion 60 as demonstrated by the change in angle θ shown in FIGS. 4 and 5. In particular, angle θ is preferably at a minimum (approximately 0°) at or adjacent both leading and trailing edges 32 and 34, respectively. Thereafter, angle θ preferably increases gradually to a maximum angle (depicted in FIG. 4)located at a midpoint 62 on first tip rib 50 (see FIG. 3). Midpoint 62 is preferably located within designated portion 60 of first tip rib 50, which is identified as approximately between one-fourth to three-fourths the distance from leading edge 32 to trailing edge 34. Due to the varying nature of angle θ, it preferably is within a range of approximately 0°–70°, more preferably within a range of approximately 20°–65°, and optimally within a range of approximately 40°–60° as it changes within designated portion 60.

It will be appreciated that designated portion 60 is an axial length of airfoil 24 which preferably extends for approximately 5–95% of a chord through airfoil 24. Designated portion 60 more preferably extends for approximately 7–80% of a chord through airfoil 24 and optimally extends for approximately 10–70% of a chord through airfoil 24.

By orienting first tip rib 50 in this manner, a first recirculation zone 64 of combustion gases 12 is formed adjacent a distal end 66 of first tip rib 50. First recirculation zone 64 then functions to reduce the leakage flow of combustion gases (identified by flow arrows 68) and, in effect, shrink the size of a gap 70 between blade tip 38 and shroud 20 without risking a rub. Generally speaking, it will be understood that recirculation zone 64 increases in size as angle θ is increased.

It will further be appreciated that relationships exist between the height of first tip rib 50, the depth of tip shelf 56, and angle θ between longitudinal axis 58 and radial axis 17. In particular, a tangent of angle θ is substantially equivalent to the depth of tip shelf 56 divided by the height of first tip rib 50. Thus, the greater angle θ becomes, the more depth of tip shelf 56 is required for a given rib tip height. Inherent limitations on tip shelf depth therefore translate into restrictions on angle θ. It will also be recognized that modifications in the height of first tip rib 50 may be made since recirculation zone 64 serves to shrink the size of gap 70 as noted hereinabove. This means that angle θ may increase by lessening the height of first rib tip 50 for a given tip shelf depth, which also has the advantage of lessening the risk of a rub between first rib tip 50 and shroud 20.

Figure 10A:
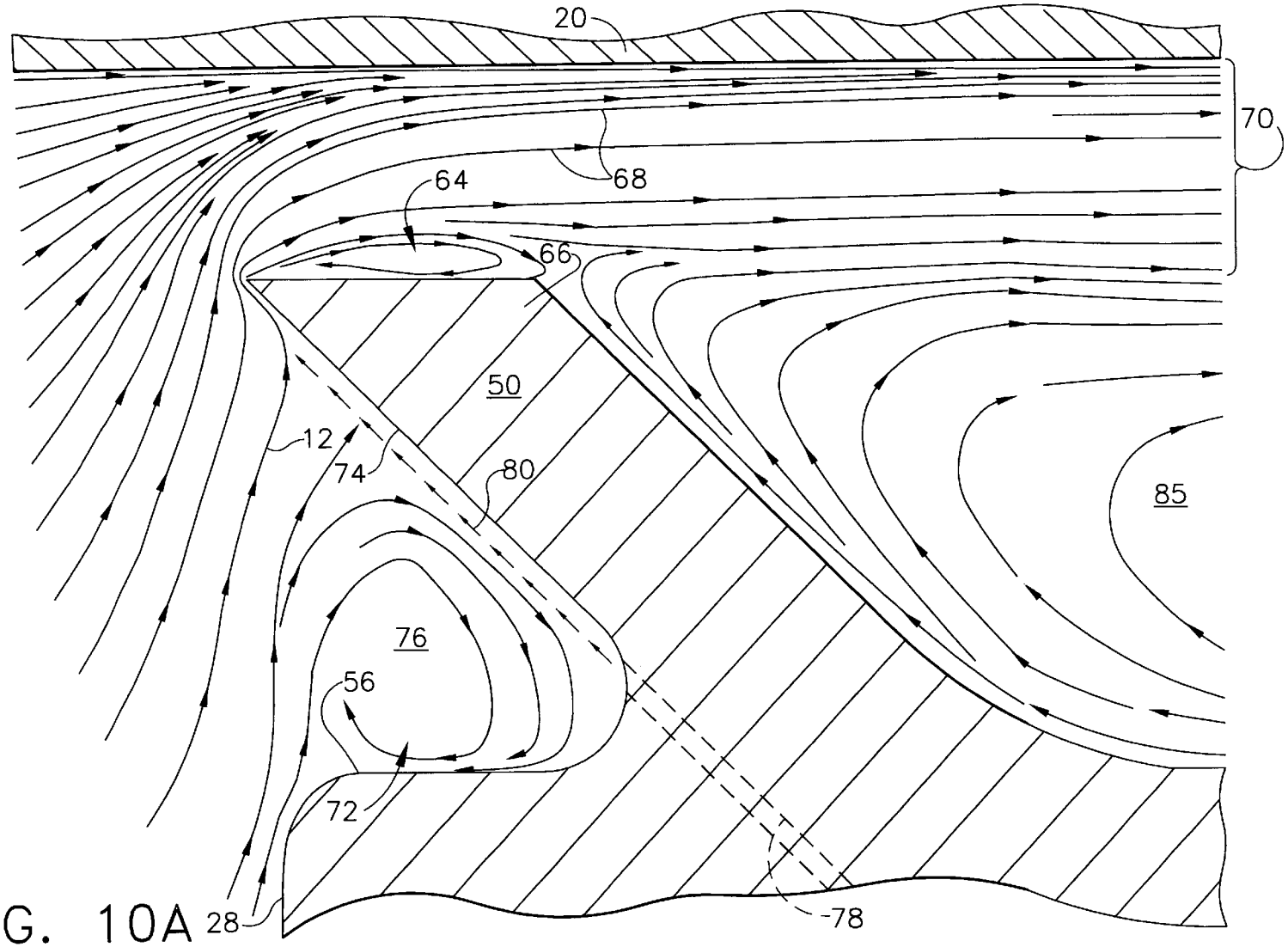
FIG. 10A is an enlarged, partial sectional view through the blade tip illustrated in FIG. 4 within the turbine shroud depicting the flow of combustion gases adjacent the pressure side blade tip rib and through the gap between such rib and the turbine shroud; and, FIG. 10B is an enlarged, partial sectional view through the blade tip illustrated in FIG. 4 within the turbine shroud depicting the flow of combustion gases adjacent the suction side blade tip rib, the area between the pressure and suction side blade tip ribs, and through the gap between such ribs and the turbine shroud.

It will also be appreciated that a pocket 72 is formed between a surface 74 of first tip rib 50 and tip shelf 56 which promotes a second recirculation zone 76 of combustion gases 12 to be formed therein. Since a plurality of cooling holes 78 are preferably provided within tip shelf 56 to provide a cooling film 80 along first tip rib surface 74, pocket 72 and second recirculation zone 76 assist in maintaining cooling film 80 near first tip rib 50 (see FIG. 10A). Accordingly, the flow of combustion gases 12 is deflected by first tip rib 50 and cooling film 80 and pushed away from gap 70. This flow deflection therefore results in increased flow resistance for the leakage flow through gap 70 and maintains cooling film 80 to better cool first tip rib 50.

It will further be understood that first tip rib 50 may be altered so as to be tapered longitudinally from a first end located adjacent tip plate 48 to distal end 66, as disclosed in U.S. Pat. No. 6,190,129 to Mayer et al., so as to increase the cooling conduction thereof. Distal end 66 of first tip rib 50 may also be tapered in accordance with the teachings of U.S. Pat. No. 6,086,328 to Lee in order to reduce the thermal stress at such location so long as first recirculation zone 64 is preserved.

Figure 6:
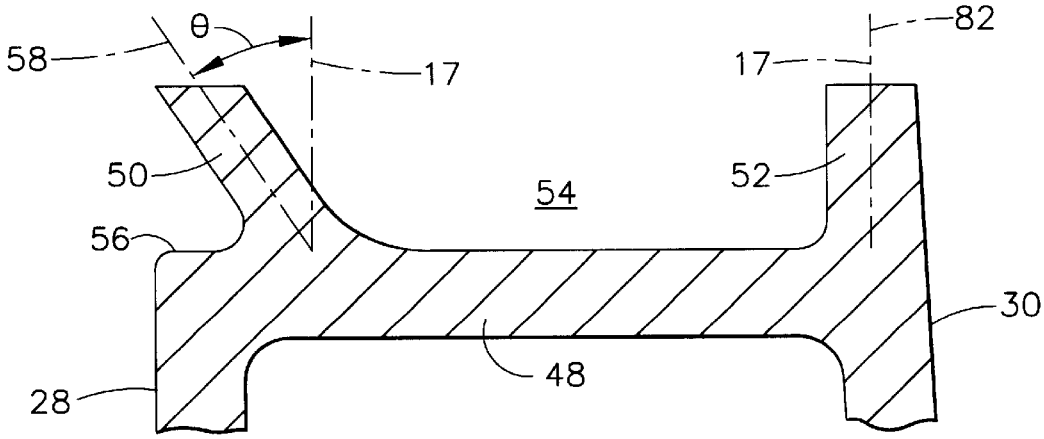
FIG. 6 is an elevational, sectional view through an alternative blade tip like that illustrated in FIGS. 4 and 5, where a longitudinal axis through the blade tip rib at the pressure side of the airfoil forms an acute angle with respect to the radial axis and the blade tip rib at the suction side of the airfoil is substantially parallel to the radial axis.
Figure 10B:
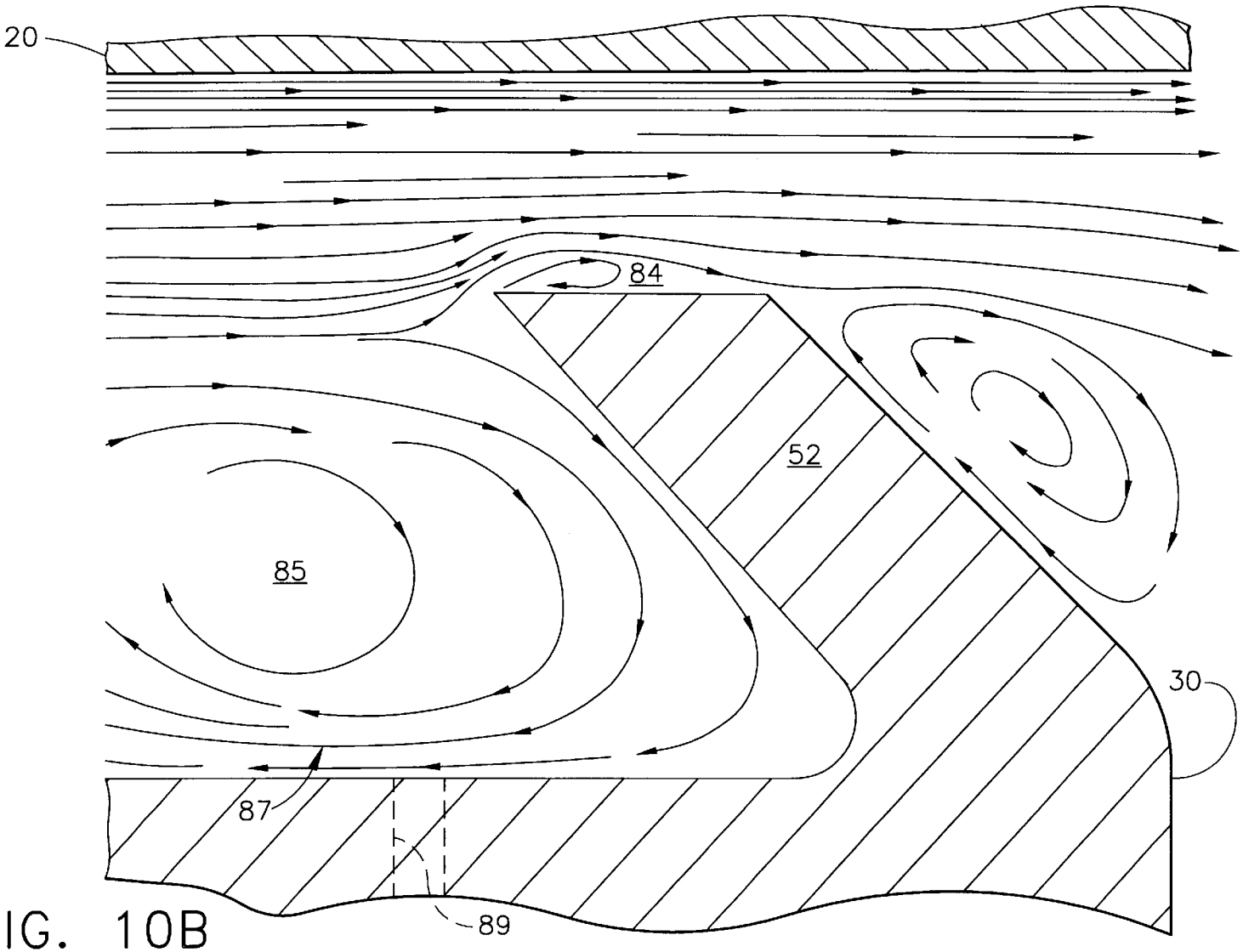

As depicted in FIG. 6, first tip rib 50 may be inclined with respect to radial axis 17 and a longitudinal axis 82 of second tip rib 52 may remain substantially parallel to radial axis 17. It is preferred, however, that second tip rib 52 be oriented so as to be substantially parallel to first tip rib 50 as it extends from leading edge 32 to trailing edge 34 at least within designated region 60 (see FIGS. 4 and 5) so that an angle J exists between longitudinal axis 82 and radial axis 17. In this way, a third recirculation zone 84 is preferably formed at a distal end 86 of second tip rib 52 similar to first recirculation zone 64 described with respect to first tip rib 50 (see FIG. 10B). Third recirculation zone 84 then assists in increasing the flow resistance through gap 70 like first recirculation zone 64. Further, it will be noted that a fourth recirculation zone 85 is generally formed within an area 87 located between first tip rib 50 and second tip rib 52. Since recirculation of hot combustion gases 12 exists in area 87, one or more cooling holes 89 are preferably formed through tip plate 48.

Figure 7:
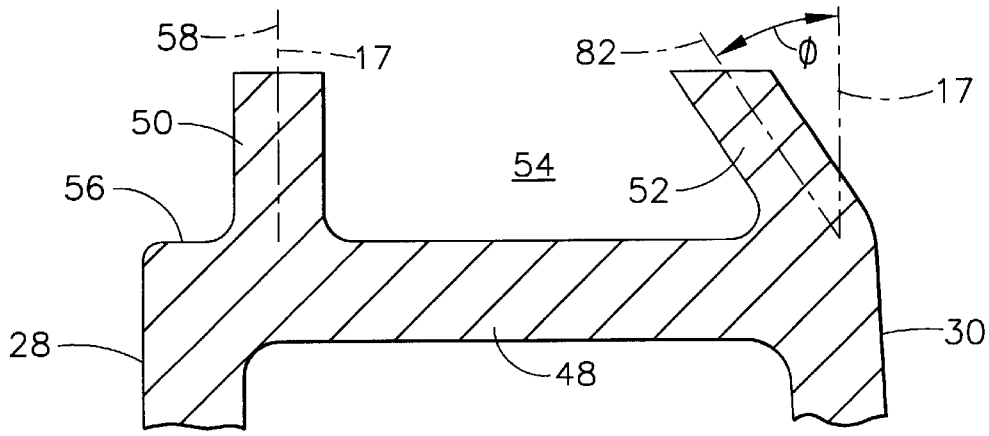
FIG. 7 is an elevational, sectional view through a second alternative blade tip like that illustrated in FIGS. 4 and 5, where a longitudinal axis through the blade tip rib at the suction side of the airfoil forms an acute angle with respect to the radial axis in the upstream direction and the blade tip rib at the pressure side of the airfoil is substantially parallel to the radial axis.
Figure 8:
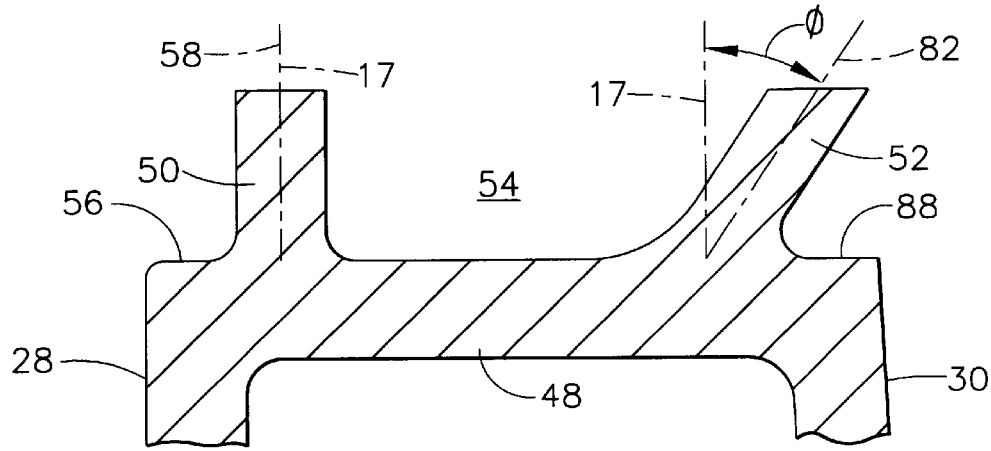
FIG. 8 is an elevational, sectional view through a third alternative blade tip like that illustrated in FIGS. 4 and 5, where a longitudinal axis through the blade tip rib at the suction side of the airfoil forms an acute angle with respect to the radial axis in the downstream direction and the blade tip rib at the pressure side of the airfoil is substantially parallel to the radial axis.

In fact, alternative embodiments depicted in FIGS. 7 and 8 illustrate that second tip rib 52 may be angled with respect to radial axis 17 while first tip rib 50 remains substantially parallel to radial axis 17. This angle ϕ may be at an acute angle in the upstream direction (herein referred to as the positive direction) as shown in FIG. 7 or at an acute angle with respect to radial axis 17 in the downstream direction (herein referred to as the negative direction) as shown in FIG. 8. It will be understood that angle ϕ will preferably have a range of approximately +60° to approximately −60°. It will also be noted from FIG. 8 that second rib tip 52 may be recessed with respect to suction sidewall 30 to form a tip shelf 88 when inclined in the negative (downstream) direction.

Figure 9:
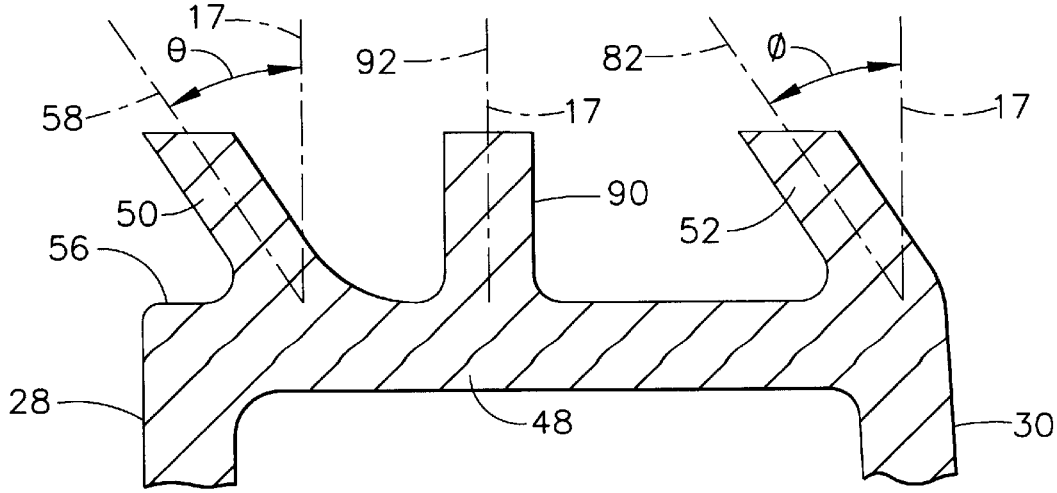
FIG. 9 is an elevational, sectional view through a fourth alternative blade tip like that illustrated in FIGS. 4 and 5, where a third intermediate blade tip rib is positioned between the blade tip ribs located adjacent the pressure and suction sides of the airfoil.

Yet another alternative configuration involves the inclusion of a third tip rib 90 located between first and second tip ribs 50 and 52, respectively, similar to that described in U.S. Pat. No. 6,224,336 (see FIG. 9). Preferably, third tip rib 90 is oriented so that a longitudinal axis 92 therethrough is substantially parallel to radial axis 17.

Having shown and described the preferred embodiment of the present invention, further adaptations of turbine blade and tip thereof can be accomplished by appropriate modifications by one of ordinary skill in the art without departing from the scope of the invention. In particular, certain turbine blades in the art which twist from their leading edge to their trailing edge and/or from their root to the tip may also utilize the rib tip configurations presented herein with appropriate modification so as to create the desired recirculation zones for decreasing tip leakage flow.

What is claimed is:

1. A turbine blade for a gas turbine engine including an airfoil and integral dovetail for mounting said airfoil along a radial axis to a rotor disk inboard of a turbine shroud, said airfoil comprising:

(a) first and second sidewalls joined together at a leading edge and a trailing edge, said first and second sidewalls extending from a root disposed adjacent said dovetail to a tip plate for channeling combustion gases thereover; and (b) at least one tip rib extending outwardly from said tip plate, said tip rib being oriented so as to extend substantially between said leading and trailing edges;

wherein said tip rib is oriented so that an axis extending longitudinally therethrough is at an angle with respect to said radial axis for at least a designated portion of an axial length of said turbine blade.

2. The turbine blade of claim 1, wherein said angle between said longitudinal axis and said radial axis is substantially the same across said designated portion.

3. The turbine blade of claim 1, wherein said angle between said longitudinal axis and said radial axis varies across said designated portion.

4. The turbine blade of claim 3, wherein a minimum angle between said longitudinal axis of said tip rib and said radial axis is located adjacent said leading and tailing edge and gradually increases to a maximum angle at a designated point therebetween.

5. The turbine blade of claim 4, wherein said designated point for said maximum angle is located approximately one-fourth to one-half the distance from said leading edge to said trailing edge.

6. The turbine blade of claim 1, wherein said angle between said longitudinal axis and said radial axis is in a range of approximately 0°–70°.

7. The turbine blade of claim 1, wherein said angle between said longitudinal axis and said radial axis is in a range of approximately 20°–65°.

8. The turbine blade of claim 1, wherein said angle between said longitudinal axis and said radial axis is in a range of approximately 40°–60°.

9. The turbine blade of claim 1, further comprising a first tip rib located adjacent to said first sidewall and a second tip rib located adjacent to said second sidewall, wherein said first rib tip is oriented so that an axis extending longitudinally therethrough is at an angle with respect to said radial axis for at least a designated portion of an axial length of said turbine blade.

10. The turbine blade of claim 9, wherein said first tip rib is recessed with respect to said first sidewall to form a tip shelf adjacent said first tip rib.

11. The turbine blade of claim 1, further comprising a first tip rib located adjacent to said first sidewall and a second tip rib located adjacent to said second sidewall, wherein said second rib tip is oriented so that an axis extending longitudinally therethrough is at an angle with respect to said radial axis for at least a designated portion of an axial length of said turbine blade.

12. The turbine blade of claim 11, wherein said second tip rib is recessed with respect to said second sidewall to form a tip shelf adjacent said second tip rib.

13. The turbine blade of claim 11, wherein said angle between said longitudinal axis and said radial axis is in a range of approximately +60° to −60°.

14. The turbine blade of claim 1, further comprising a first tip rib located adjacent to said first sidewall and a second tip rib located adjacent to said second sidewall, wherein said first and second tip ribs are oriented so that an axis extending longitudinally through each respective tip rib is at an angle with respect to said radial axis for at least a designated portion of an axial length of said turbine blade.

15. The turbine blade of claim 14, further comprising a third tip rib extending outwardly from said tip plate between said leading and trailing edges, said third tip rib being spaced laterally between said first and second tip ribs.

16. The turbine blade of claim 1, wherein said angle between said longitudinal axis of said tip rib and said radial axis is more than approximately 5° for said designated portion of said rib.

17. The turbine blade of claim 1, wherein said designated portion extends for approximately 5–95% of a chord through said blade.

18. The turbine blade of claim 1, wherein said designated portion extends for approximately 7–80% of a chord through said blade.

19. The turbine blade of claim 1, wherein said designated portion extends for approximately 10–70% of a chord through said blade.

20. The turbine blade of claim 1, further comprising a plurality of cooling holes located adjacent to said tip rib in communication with a cooling channel disposed in said airfoil for receiving cooling fluid through said dovetail and providing a cooling film along at least one surface of said tip rib.

21. The turbine blade of claim 20, herein a junction between said first tip rib and said tip shelf is radiused so as to form a recirculation zone therein for said combustion gases and thereby maintain aid cooling film.

22. A turbine blade for a gas turbine engine including an airfoil and integral dovetail for mounting said airfoil along a radial axis to a rotor disk inboard of a turbine shroud, said airfoil comprising:

(a) first and second sidewalls joined together at a leading edge and a tailing edge, said first and second sidewalls extending from a root disposed adjacent said dovetail to a tip plate for channeling combustion gases thereover; and (b) at least one tip rib extending outwardly from said tip plate said tip rib being oriented so as to extend substantially between said leading and trailing edges;

wherein said tip rib is oriented with respect to said radial axis so that a first recirculation zone of said combustion gases is formed adjacent a distal end of said tip rib which reduces a leakage flow of said combustion gases between said airfoil and said shroud for at least a designed portion of an axial length of said turbine blade.

23. The turbine blade of claim 22, said tip rib further being recessed with respect to said first sidewall to form a tip shelf adjacent said tip rib, wherein a junction between said first tip rib and said tip shelf is radiused so that a second recirculation zone of said combustion gases is formed therein which assists in maintaining a cooling film along said tip rib.

24. The turbine blade of claim 22, further comprising a first tip rib located adjacent to said first sidewall and a second tip rib located adjacent to said second sidewall wherein said first and second tip ribs are oriented with respect to said radial axis so that a first recirculation zone of said combustion gases is formed adjacent a distal end of said first tip rib and a second recirculation zone of said combustion gases is formed adjacent a distal end of said second tip rib, said first and second recirculation zones functioning to reduce a leakage flow of said combustion gases between said airfoil and said shroud for at least a designated portion of an axial length of said turbine blade.

25. The turbine blade of claim 24, wherein a first junction between said first tip rib and said tip plate and a second junction between said second tip rib and said tip plate are radiused so that a third recirculation zone of said combustion gases is formed between said first and second tip ribs.

* * * * *